US007311492B2

(12) United States Patent
Östberg

(10) Patent No.: US 7,311,492 B2
(45) Date of Patent: Dec. 25, 2007

(54) DUCT FAN

(76) Inventor: Hans Östberg, Banmästargränd 2, SE-770 70 Långshyttan (SE)

( * ) Notice: Subject to any disclaimer, the term of this patent is extended or adjusted under 35 U.S.C. 154(b) by 0 days.

(21) Appl. No.: 11/273,359

(22) Filed: Nov. 14, 2005

(65) Prior Publication Data

US 2006/0127213 A1 Jun. 15, 2006

(30) Foreign Application Priority Data

Nov. 12, 2004 (EP) ..... 04105737

(51) Int. Cl.
*F04D 29/40* (2006.01)

(52) U.S. Cl. ..... 415/126; 415/182.1; 415/219.1; 415/220

(58) Field of Classification Search ..... 415/126, 415/182.1, 214.1, 219.1, 220–227
See application file for complete search history.

(56) References Cited

U.S. PATENT DOCUMENTS 3,312,386 A * 4/1967 Hull et al. ..... 415/218.1
3,726,611 A 4/1973 Astrom

FOREIGN PATENT DOCUMENTS

| | | |
|---|---|---|
| FR | 2710700 | 4/1995 |
| GB | 911111 | 11/1962 |
| GB | 1326237 | 8/1973 |

* cited by examiner

*Primary Examiner*—Igor Kershteyn
(74) *Attorney, Agent, or Firm*—Dilworth & Barrese LLP

(57) ABSTRACT

A duct fan comprises a housing (4) having substantially the shape of a rectangular parallelepiped and inside thereof an impeller (5) and a motor for rotation thereof. The fan has also a member for connecting an inlet side of the housing to an upstream duct part for sucking air in therefrom and a member for connecting an outlet side of the housing to a downstream duct part for exhausting air thereto. The impeller is a radial impeller having the axis of rotation substantially perpendicular to the direction of the main transport of air from the inlet to the outlet. The outlet connecting member is designed to define an airflow path tapering substantially conically in the outlet towards the end of that member adapted to adjoin to a said downstream duct part.

28 Claims, 2 Drawing Sheets

DUCT FAN

BACKGROUND OF THE INVENTION AND PRIOR ART

The present invention relates to a duct fan adapted to be arranged in a duct for transport of air between an upstream duct part and a downstream duct part according to the description herein.

Accordingly, duct fans are fans installed in ducts for transport of air for forcing air through these ducts and they are sometimes also called "in line centrifugal fans". The ducts may be of any type in which it is a desire to transport air, such as ventilation ducts in any type of building, such as in dwelling houses, in industrial premises, in sports halls and the like, and air is here to be interpreted to include any gases or gas mixtures, such as air contaminated with any other gas, such as carbon monoxide.

Duct fans for transport of air in circular ducts were until now mostly so-called circular duct fans having an impeller with the axis of rotation substantially in parallel with the direction of the main transport of air from the inlet to the outlet of the fan and when installed between an upstream duct part and a downstream duct part by that substantially in parallel with the extension of that duct in that region. However, such circular duct fans require comparatively much space in the direction perpendicular to said axis of rotation of the impeller, which often means in the vertical direction, since the ducts in question are often extending directly under or in ceilings of buildings. This means a waste of space that may be utilised in a more efficient way.

Furthermore, the pressure that may be obtained through such a circular duct fan in a duct is not as high as desired, at the same time as the noise level is rather high.

Duct fans of the type defined in the description herein, i.e. having a radial impeller having the axis of rotation substantially perpendicular to the direction of the main transport of air from the inlet to the outlet, have for that sake been put on the market. Such duct fans may be constructed with smaller dimensions in the transversedirection thereof, i.e. in the direction substantially perpendicular to the direction of the main transport of air from the inlet to the outlet, which in the practice means a lower height and less space demand in that context. Although such a duct fan is preferred with respect to a circular duct fan also with respect to obtainable pressure, noise level and efficiency, there is a desire to further improve the properties thereof.

SUMMARY OF THE INVENTION

The object of the present invention is to provide a duct fan of the type defined in the introduction, which is improved with respect to such duct fans already known.

This object is according to the invention obtained by designing the outlet connecting member of such a duct fan to define an air flow path tapering substantially conically in the outlet towards the end of that member adapted to adjoin to a said downstream duct part.

It has turned out that such an outlet connecting member defining an air flow path tapering substantially conically results in a fan having an even lower noise level. Furthermore, the efficiency and the capacity (pressure/flow) are improved.

According to a preferred embodiment of the invention the centre line of the opening of the outlet connecting member cone for connecting to a said downstream duct part, when viewing the housing in the direction of the axis of rotation of the impeller, is substantially offset with respect to a centre line of the housing extending from said first to said second housing side. Such an offset location of said opening further improves the properties mentioned above of the duct fan, and this is in particular the case when the outlet connecting member then is adapted to define said air flow path by wall portions extending substantially rectilinearly from the outer boarder of said second housing side to said end for adjoining to a said downstream duct part, so that the degree of tapering of said wall portions will differ as a consequence of said offset location of said opening.

According to another preferred embodiment of the invention the impeller has blades curved backwards with respect to the rotation direction of the impeller. Such an impeller is particularly preferred, since the fan will work very efficient without any need of any particular guiding means, so that the impeller may be arranged in a space in said housing laterally delimited by lateral walls of the housing and opening directly into said outlet connecting member, and walls defining said space are adapted to alone take care of the guiding of airflow generated by the impeller inside said space. This also means saving of costs for the construction of the fan.

According to another preferred embodiment of the invention the impeller has blades curved forwards with respect to the rotation direction of the impeller, and a worm plate is arranged in a space in said housing containing the impeller for guiding the airflow generated by the impeller inside said space. An advantage of this design is that the impeller will have a reduced diameter, so that it is possible to obtain a more compact construction of the duct fan. This type of fan is especially suited for higher air pressures, where it has a commercially interesting efficiency.

According to another preferred embodiment of the invention the axis of rotation of the impeller is offset with respect to a centre line of the housing extending from said first to said second housing side. Such an offset location of the impeller further improves the efficiency and capacity of the fan.

According to another preferred embodiment of the invention the inlet connecting member is designed to define an airflow path expanding substantially conically from the end of that member adapted to adjoin to a said upstream duct part and towards said housing. The use of such a conical connecting member also for the inlet contributes to improved properties with respect to obtainable flow and pressure and efficiency of the duct fan.

It is also preferred that said opening of the outlet connecting member cone and said opening of the inlet connecting member cone are substantially aligned, when viewing the housing in the direction of the axis of rotation of the impeller, since this means that the duct fan may be connected to an upstream duct part and a downstream duct part being aligned, so that the duct fan will in the practise constitute a duct part with a substantially rectilinear extension. Thanks to this conical design of the inlet and outlet connecting members it is possible to have this alignment without reducing the efficiency of the fan.

According to another preferred embodiment of the invention the interior of the housing is divided into two rooms by a partition wall extending substantially perpendicularly to the axis of rotation of the impeller, namely an inlet room and an outlet room, the impeller being arranged in the outlet room, and the partition wall is provided with an opening at the location of the impeller for sucking in air from the inlet room into the outlet room by rotation of the impeller, which is a favourable way of realising a duct fan having an impeller with the axis of rotation substantially perpendicular to the direction of the main transport of air from the inlet to the outlet.

According to another preferred embodiment of the invention constituting a further development of the embodiment last mentioned the duct fan comprises a guide plate extending inside the inlet room substantially in the direction of a said upstream duct part to which the inlet connecting member is adapted to be connected and across said opening in the partition wall while dividing this into substantially equal parts. The arrangement of such a guide plate further improves the capacity of the duct fan by stopping detrimental rotations of air in the inlet of the fan.

According to another preferred embodiment of the invention a plate for suspension of the impeller with motor is designed as a lid hinged with respect to the housing for enabling pivoting of this lid upwards for lifting the impeller with motor out of said housing for inspection, maintenance and/or cleaning.

Further advantages as well as advantageous features will appear from the following description.

BRIEF DESCRIPTION OF THE DRAWINGS

With reference to the appended drawings, below follows a specific description of a duct fan according to a preferred embodiment of the invention.

In the drawings.

DESCRIPTION OF THE PREFERRED EMBODIMENTS

Figure 1:
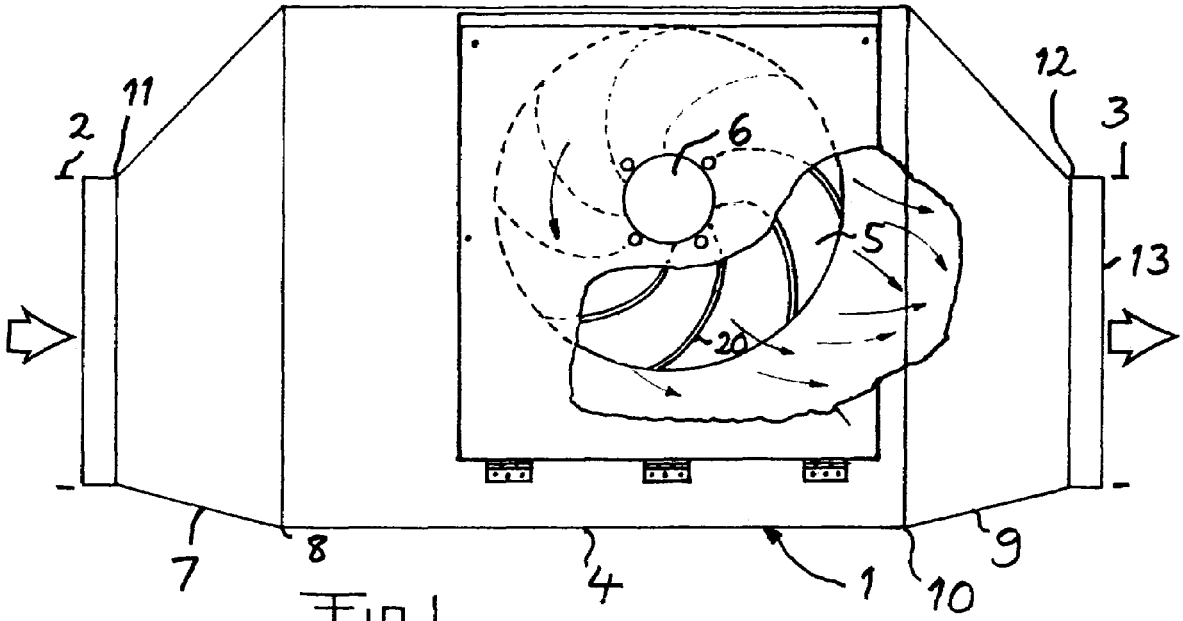
FIG. 1 is a view from above of a duct fan according a preferred embodiment of the invention with parts of the walls broken away.
Figure 2:
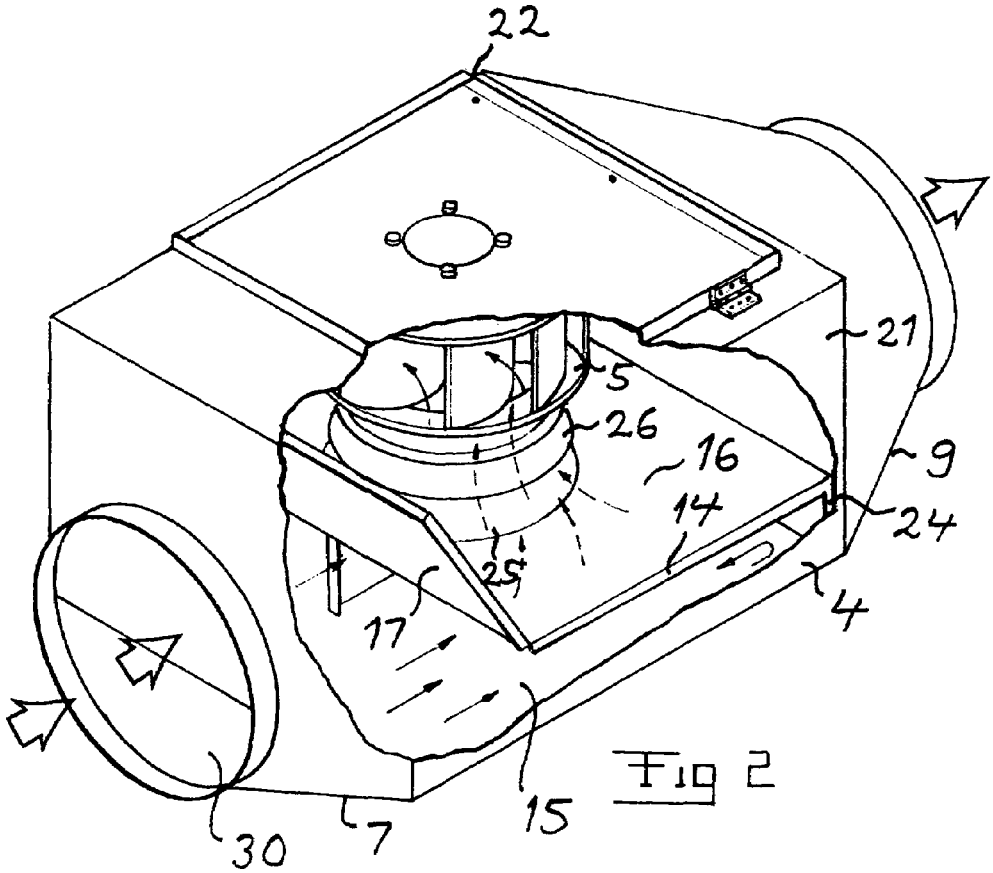
FIG. 2 is a perspective view of the duct fan according to FIG. 1 with parts of the walls broken away.

A duct fan according to a preferred embodiment of the invention is illustrated in appended FIGS. 1-4 and will now be described while simultaneously making reference to all these figures. The duct fan 1 is adapted to be arranged in a duct for transport of air between an upstream duct part 2 and a downstream duct part 3 schematically indicated in FIG. 1. These two duct part 2, 3 are in this case in line, and a fan of this kind is also called an in line fan. The fan comprises a housing 4 preferably made of metal sheet and having substantially the shape of a rectangular parallelepiped and inside thereof a fan member in the form of an impeller 5 and a schematically indicated motor 6 for rotation thereof. A duct fan of this type has typically an air flow of 0.10 $m^3$/sec-3 $m^3$/sec, but the invention is not restricted to this range.

The fan also comprises a member 7 for connecting a first inlet side 8 of the housing to a said upstream duct part for sucking air in therefrom and a member 9 for connecting a second outlet side 10 of the housing located opposite to said first side to a said downstream duct part for exhausting air thereto. The inlet connecting member is designed to define an airflow path expanding substantially conically from the end 11 of that member adapted to adjoin to a said upstream duct part and towards said housing 4. The impeller 5 is a radial impeller having the axis of rotation substantially perpendicular to the direction of the main transport of air from said inlet to said outlet, and when viewing the housing in the direction of the axis of rotation of the impeller, the centre line of the opening 30 of the inlet connecting member cone for connecting to a said upstream duct part is substantially offset with respect to a centre line of the housing extending from said first to said second housing side. The inlet connecting member is adapted to define said airflow path by wall portions extending substantially rectilinearly from the outer boarder of said first housing side 8 to said end 11 for adjoining to a said upstream duct part, so that the degree of diverging of said wall portions will differ as a consequence of said offset location of said opening. This design of the inlet connecting member of the fan reduces the noise level of the fan and improves the capacity thereof. The outlet connecting member 9 has a similar design to that of the inlet connecting member, and it is designed to define an airflow path tapering substantially conically in the outlet towards the end 12 of that member adapted to adjoin to a said downstream duct part. When viewing the housing in the direction of the axis of rotation of the impeller, the centre line of the opening 13 of the outlet connecting member cone for connecting to a said downstream duct part is substantially offset with respect to a centre line of the housing extending from said first to said second housing side. This offset location of the outlet means that the outlet may be more concentrated to the location where the air is exhausted from the impeller, and the exhaust side of the impeller laterally seen shall be on the same side of the housing centre line as said outlet centre line as seen in the direction of the axis of rotation of the impeller. The outlet connecting member 9 is also adapted to define said airflow path by wall portions extending substantially rectilinearly from the outer boarder of the second housing side 10 to said end 12 for adjoining to a said downstream duct part, so that the degree of tapering of said wall portions will differ for wall portions at different circumferential locations with respect to the opening 13 as a consequence of said offset location of said opening. This design of the outlet connecting member of a duct fan according to the invention reduces the noise level of the fan and improves the capacity thereof substantially, especially in connection with the design and location of the impeller as described further below.

The interior of the housing 4 is divided into two rooms by a partition wall 14 extending substantially perpendicularly to the axis of rotation of the impeller, namely an inlet room 15 and an outlet room 16. The partition wall 14 has also an end part 17 extending in an angle to the other part for increasing the cross-section of the inlet room 15 towards the inlet connecting member 7 and an end part 24 closing the inlet room with respect to the outlet of the outlet connecting member 9. The impeller 5 is arranged in the outlet room, and the partition wall 14 is provided with an opening 18 having a nozzle 25 extending into the outlet room 16 at the location of the impeller for sucking in air from the inlet room 15 into the outlet room 16 by rotation of the impeller.

Figure 3:
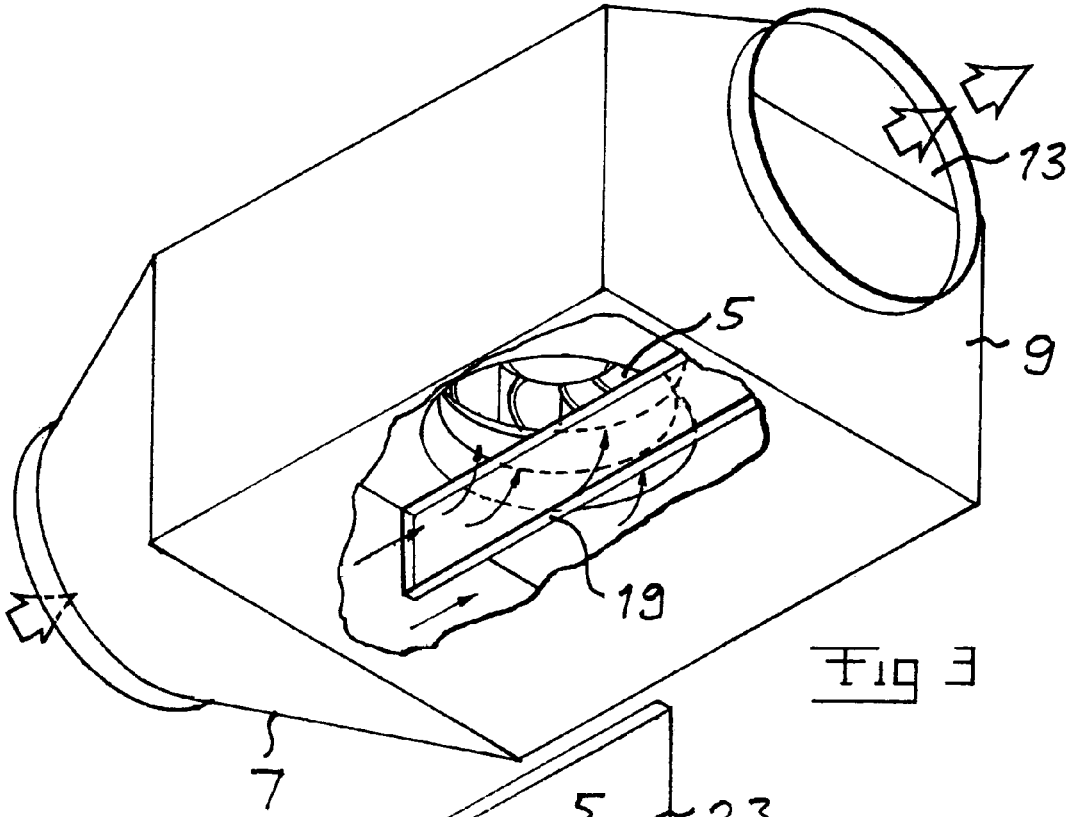
FIG. 3 is a perspective view obliquely from below of the duct fan according to FIGS. 1 and 2.

The fan also comprises a guide plate 19 shown in FIG. 3 and extending inside the inlet room substantially in the direction of said upstream duct part to which the inlet connecting member is adapted to be connected and across said opening 18 in the partition wall 14 while dividing this in two substantially equal parts. This guide plate increases the capacity of the fan by stopping rotation of air in the inlet of the fan.

The impeller 5 has blades 20 curved backwards with respect to the rotation direction of the impeller. This means that the impeller may be arranged in said outlet room 16 in said housing laterally delimited by lateral walls 21, 22 and opening directly into the outlet connecting member while walls defining the outlet room 16 are adapted to alone take care of the guiding of airflow generated by the impeller inside said outlet room. Thus, no worm or shell plate is needed for efficiently forcing the air sucked in through the opening 18 in the partition wall towards the opening 13 to a downstream duct part thanks to the construction of the impeller with blades being curved backwards. Furthermore, the impeller is arranged with the axis of rotation thereof offset with respect to the centre line of the housing. This location improves the capacity, i.e. pressure/flow, of the duct fan according to the invention further.

Figure 4:
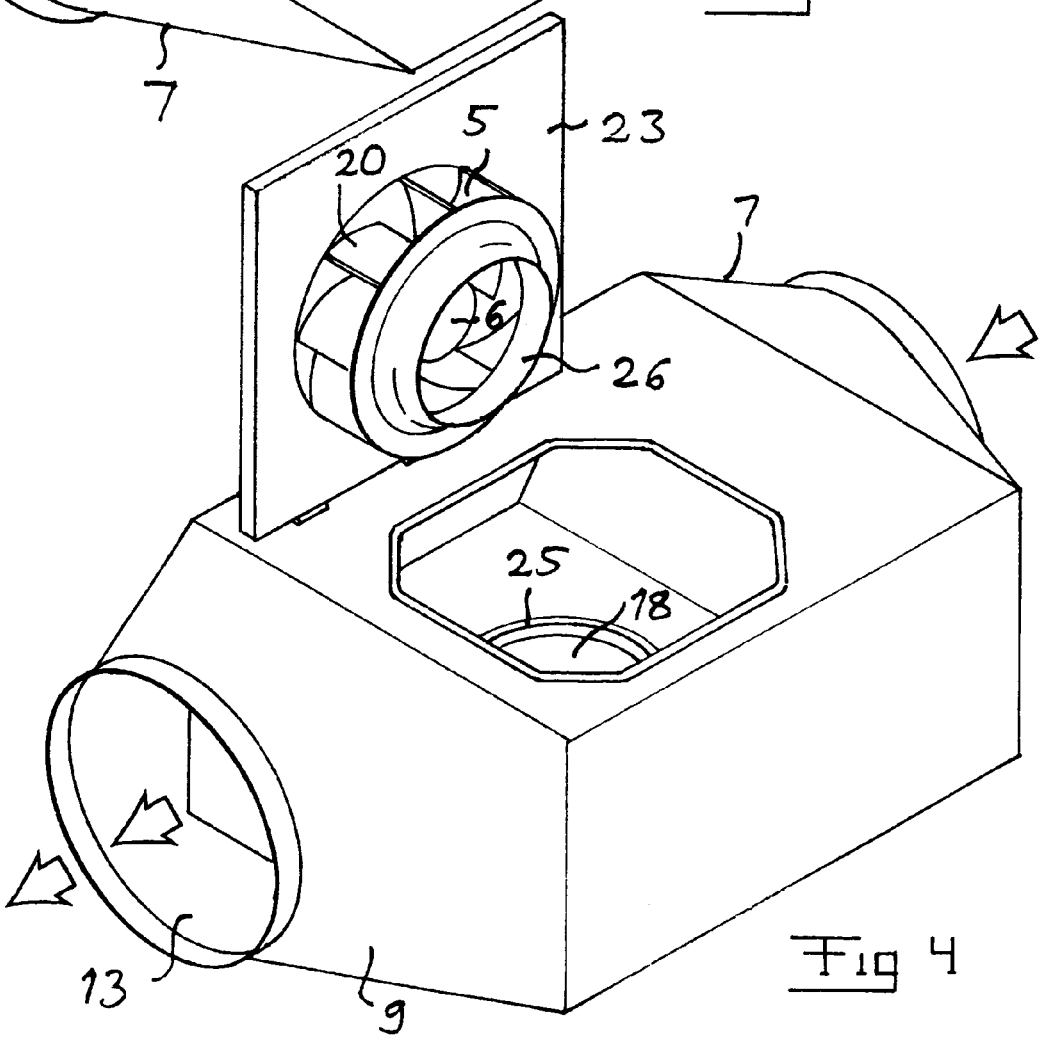
FIG. 4 is a perspective view of a duct fan in which an impeller with motor is lifted out of the housing for inspection, maintenance and/or cleaning.

The impeller 5 with motor is suspended in a substantially rectangular plate 23. The plate 23 for suspension of the impeller with motor is designed as a lid hinged with respect to the rest of the housing for enabling pivoting of this lid upwards for lifting the impeller with motor out of said housing for inspection, maintenance and/or cleaning as shown in FIG. 4. The impeller has lower circumferential portions 26 adapted to form a wrap over with respect to said nozzle 25 with a small clearance when the lid 23 is swung down for guiding substantially all air from the inlet room to the outlet room through the impeller.

The function of the duct fan appears clearly from above but will now be briefly summarised. The impeller located inside the outlet room 16 will suck air into the opening 30 of the inlet connecting member 7 into the inlet room 15 and through the opening 18 the outlet room 16 and through the conically tapering outlet connecting member to the opening 13 thereof into a downstream duct part. The design of the outlet connecting member so that this part gets a cross section gradually decreasing in the direction of the opening 13 into a downstream duct part is the most essential feature improving the capacity and the efficiency of the duct fan, and it is also favourable for reducing the noise level thereof. Thanks to the use of an impeller having blades curved backwards material and costs are also saved, since no worm or shell plate is needed for guiding the air inside the outlet room. The offset location of the opening 13 of the outlet connecting member cone with respect to especially the axis of rotation of the impeller is also favourable for the capacity and efficiency of the fan.

The invention is of course not in any way restricted to the preferred embodiment described above, but many possibilities to modifications thereof would be apparent to a person with ordinary skill in the art without departing from the basic idea of the invention as defined in the appended claims.

It is for instance within the scope of the invention to use an impeller having blades curved forwards with respect to the rotation direction of the impeller, but in such a case a worm plate has to be arranged in the outlet room of the housing for guiding the airflow generated by the impeller inside this outlet room.

Although it is mostly favourable, it is not necessary that the inlet and the outlet of the duct fan are aligned as shown in the figures, but they may well be displaced with respect to each other transversely to a said centre line.

It is also possible that the cone of the outlet connecting member does not extend from the outer boarder of the second housing side, but from end wall portions of said parallelepiped extending slightly inwards from this outer boarder, but an extension from the outer boarder would in most cases be preferred.

Although the influence of gravitation would mostly make an arrangement of the duct fan with the partition wall extending substantially horizontal and with the impeller located in the upper room of the housing the invention is not restricted thereto, and this is the reason why the words horizontal and vertical has not been used when defining the duct fan, since it may in some cases be adapted to be arranged otherwise.

It is shown in the figures how the outlet connecting member as well as the inlet connecting member have a short circular flange at the opening to the respective duct part, and it is pointed out that such a design of the respective connecting member is within the definitions of the designs of these members made in the description and in the claims.

It is conceivable to have the impeller arranged centrally, i.e. with the axis of rotation thereof on said housing centre line, when an impeller having blades curved backwards is used.

Although not shown in the figures the four walls of the fan extending from the inlet to the outlet thereof are preferably externally covered by a layer with sound and fire insulating properties, such as of glass wool or mineral wool and having typically a thickness of 3-6 cm. At the position of the lid this layer is then divided for forming a separate lid thereof.

It is pointed out that "substantially conically" with respect to the tapering of the outlet and inlet connecting members also covers appearances deviating slightly from a cone not only by having a tapering differing over the circumference thereof as shown in the figures, but also as a consequence of the manufacturing process used. Thus, when these connecting members are manufactured by cold drawing of a metal sheet it is hard to avoid that some irregularities appear in the shape of said cone then not being as smooth as shown in the figures. Such shapes are also intended to be-covered by the definition "substantially conically".

The invention claimed is:

1. A duct fan adapted to be arranged in a duct for transport of air between an upstream duct part and a downstream duct part, said fan comprising a housing (4) having substantially the shape of a rectangular parallelepiped and inside thereof a fan member in the form of an impeller (5) and a motor (6) for rotation thereof, a member (7) for connecting a first inlet side (8) of the housing to said upstream duct part for sucking air in therefrom and a member (9) for connecting a second outlet side (10) of the housing located opposite to said first side to said downstream duct part for exhausting air thereto, said impeller being a radial impeller having the axis of rotation substantially perpendicular to the direction of the main transport of air from said inlet to said outlet, wherein the outlet connecting member (9) is designed to define an airflow path tapering substantially conically in the outlet towards the end of that member adapted to adjoin to a said downstream duct part, and when viewing the housing (4) in the direction of the axis of rotation of the impeller, the center line of the opening (13) of the outlet connecting member (9) cone for connecting to said downstream duct part is substantially offset with respect to a center line of the housing extending from said first (8) to said second (10) housing side.

2. A duct fan according to claim 1, wherein the outlet connecting member (9) is adapted to define said air flow path by wall portions extending substantially rectilinearly from the outer border of said second housing side (10) to said end (12) for adjoining to said downstream duct part, so that the degree of tapering of said wall portions will differ as a consequence of said offset location of said opening (13).

3. A duct fan according to claim 2, wherein the impeller (5) has blades (20) curved backwards with respect to the rotation direction of the impeller.

4. A duct fan according to claim 3, wherein the impeller (5) is arranged in a space (16) in said housing laterally delimited by lateral walls (21, 22) of the housing and opening directly into said outlet connecting member (9), and walls defining said space are adapted to alone take care of the guiding of airflow generated by the impeller inside said space.

5. A duct fan according to claim 2, wherein the impeller (5) has blades curved forwards with respect to the rotation direction of the impeller, and a worm plate is arranged in a space (16) in said housing containing the impeller for guiding the airflow generated by the impeller inside said space.

6. A duct fan according to claim 1, wherein the impeller (5) has blades (20) curved backwards with respect to the rotation direction of the impeller.

7. A duct fan according to claim 6, wherein the impeller (5) is arranged in a space (16) in said housing laterally delimited by lateral walls (21, 22) of the housing and opening directly into said outlet connecting member (9), and walls defining said space are adapted to alone take care of the guiding of airflow generated by the impeller inside said space.

8. A duct fan according to claim 1, wherein the impeller (5) has blades curved forwards with respect to the rotation direction of the impeller, and a worm plate is arranged in a space (16) in said housing containing the impeller for guiding the airflow generated by the impeller inside said space.

9. A duct fan according to claim 1, wherein the inlet connecting member (7) is designed to define an airflow path expanding substantially conically from the end (11) of that member adapted to adjoin to said upstream duct part and towards said housing (4).

10. A duct fan according to claim 9, wherein, when viewing the housing (4) in the direction of the axis of rotation of the impeller (5), the center line of the opening (30) of the inlet connecting member (7) cone for connecting to said upstream duct part is substantially offset with respect to a center line of the housing extending from said first (8) to said second (10) housing side.

11. A duct fan according to claim 10, wherein the inlet connecting member (7) is adapted to define said airflow path by wall portions extending substantially rectilinearly from the outer border of said first housing side (8) to said end (11) for adjoining to said upstream duct part, so that the degree of diverging of said wall portions will differ as a consequence of said offset location of said opening.

12. A duct fan according to claim 9, wherein, when viewing the housing (4) in the direction of the axis of rotation of the impeller (5), said opening (13) of the outlet connecting member (9) cone and said opening (30) of the inlet connecting member (7) cone are substantially aligned.

13. A duct fan according to claim 1, wherein the interior of the housing (4) is divided into two rooms by a partition wall (14) extending substantially perpendicularly to the axis of rotation of the impeller (5), namely an inlet room (15) and an outlet room (16), the impeller is arranged in the outlet room, and the partition wall is provided with an opening (18) at the location of the impeller for sucking in air from the inlet room into the outlet room by the rotation of the impeller.

14. A duct fan according to claim 13, wherein it comprises a guide plate (19) extending inside the inlet room (15) substantially in the direction of a said upstream duct part to which the inlet connecting member (7) is adapted to be connected and across said opening (18) in the partition wall 14) while dividing this opening in two substantially equal parts.

15. A duct fan according to claim 1, wherein the impeller (5) with motor is suspended in a substantially rectangular plate (23) designed as a lid hinged with respect to the rest of the housing (4) for enabling pivoting of this lid upwards for lifting the impeller with motor out of said housing for inspection, maintenance and/or cleaning.

16. A duct fan adapted to be arranged in a duct for transport of air between an upstream duct part and a downstream duct part, said fan comprising a housing (4) having substantially the shape of a rectangular parallelepiped and inside thereof a fan member in the form of an impeller (5) and a motor (6) for rotation thereof, a member (7) for connecting a first inlet side (8) of the housing to said upstream duct part for sucking air in therefrom and a member (9) for connecting a second outlet side (10) of the housing located opposite to said first side to said downstream duct part for exhausting air thereto, said impeller being a radial impeller having the axis of rotation substantially perpendicular to the direction of the main transport of air from said inlet to said outlet, wherein the outlet connecting member (9) is designed to define an airflow path tapering substantially conically in the outlet towards the end of that member adapted to adjoin to a said downstream duct part, and when viewing the housing (4) in the direction of the axis of rotation of the impeller, the axis of rotation of the impeller (5) is offset with respect to a center line of the housing (4) extending from said first (8) to said second (10) housing side.

17. A duct fan according to claim 16, wherein the impeller (5) has blades (20) curved backwards with respect to the rotation direction of the impeller.

18. A duct fan according to claim 17, wherein the impeller (5) is arranged in a space (16) in said housing laterally delimited by lateral walls (21, 22) of the housing and opening directly into said outlet connecting member (9), and walls defining said space are adapted to alone take care of the guiding of airflow generated by the impeller inside said space.

19. A duct fan according to claim 16, wherein the impeller (5) has blades curved forwards with respect to the rotation direction of the impeller, and a worm plate is arranged in a space (16) in said housing containing the impeller for guiding the airflow generated by the impeller inside said space.

20. A duct fan according to claim 16, wherein the outlet connecting member (9) is adapted to define said air flow path by wall portions extending substantially rectilinearly from the outer border of said second housing side (10) to said end (12) for adjoining to said downstream duct part, so that the degree of tapering of said wall portions will differ as a consequence of said offset location of said opening (13).

21. A duct fan according to claim 20, wherein the impeller (5) has blades curved forwards with respect to the rotation direction of the impeller, and a worm plate is arranged in a space (16) in said housing containing the impeller for guiding the airflow generated by the impeller inside said space.

22. A duct fan according to claim 16, wherein the inlet connecting member (7) is designed to define an airflow path expanding substantially conically from the end (11) of that member adapted to adjoin to said upstream duct part and towards said housing (4).

23. A duct fan according to claim 22, wherein, when viewing the housing (4) in the direction of the axis of rotation of the impeller (5), the center line of the opening (30) of the inlet connecting member (7) cone for connecting to said upstream duct part is substantially offset with respect to a center line of the housing extending from said first (8) to said second (10) housing side.

24. A duct fan according to claim 23, wherein the inlet connecting member (7) is adapted to define said airflow path by wall portions extending substantially rectilinearly from the outer border of said first housing side (8) to said end (11) for adjoining to said upstream duct part, so that the degree of diverging of said wall portions will differ as a con sequence of said offset location of said opening.

25. A duct fan according to claim 22, wherein, when viewing the housing (4) in the direction of the axis of rotation of the impeller (5), said opening (13) of the outlet connecting member (9) cone and said opening (30) of the inlet connecting member (7) cone are substantially aligned.

26. A duct fan according to claim 16, wherein the interior of the housing (4) is divided into two rooms by a partition wall (14) extending substantially perpendicularly to the axis of rotation of the impeller (5), namely an inlet room (15) and an outlet room (16), the impeller is arranged in the outlet room, and the partition wall is provided with an opening (18) at the location of the impeller for sucking in air from the inlet room into the outlet room by the rotation of the impeller.

27. A duct fan according to claim 26, wherein it comprises a guide plate (19) extending inside the inlet room (15) substantially in the direction of a said upstream duct part to which the inlet connecting member (7) is adapted to be connected and across said opening (18) in the partition wall 14) while dividing this opening in two substantially equal parts.

28. A duct fan according to claim 16, wherein the impeller (5) with motor is suspended in a substantially rectangular plate (23) designed as a lid hinged with respect to the rest of the housing (4) for enabling pivoting of this lid upwards for lifting the impeller with motor out of said housing for inspection, maintenance and/or cleaning.

* * * * *